US008356540B2

(12) United States Patent
Priebe et al.

(10) Patent No.: US 8,356,540 B2
(45) Date of Patent: Jan. 22, 2013

(54) PROTECTIVE SHIELD APPARATUS

(76) Inventors: Jon Brian Priebe, Holt, MI (US); John Bryan LeGwin, DeWitt, MI (US)

( * ) Notice: Subject to any disclaimer, the term of this patent is extended or adjusted under 35 U.S.C. 154(b) by 0 days.

(21) Appl. No.: 13/098,225

(22) Filed: Apr. 29, 2011

(65) Prior Publication Data

US 2011/0226123 A1 Sep. 22, 2011

Related U.S. Application Data

(63) Continuation of application No. 12/967,941, filed on Dec. 14, 2010, now abandoned, which is a continuation of application No. 12/784,261, filed on May 20, 2010, now abandoned.

(60) Provisional application No. 61/216,912, filed on May 21, 2009.

(51) Int. Cl.
*F41H 7/00* (2006.01)

(52) U.S. Cl. ..... 89/36.07; 89/36.01; 89/36.02; 89/36.05

(58) Field of Classification Search ..... 89/36.01, 89/36.05–36.07; 2/2.5
See application file for complete search history.

(56) References Cited

U.S. PATENT DOCUMENTS

| | | | | | |
|---|---|---|---|---|---|
| 2,316,055 | A * | 4/1943 | Davey | 89/36.05 |
| 3,476,107 | A * | 11/1969 | Matt, Jr. et al. | 128/869 |
| 3,745,938 | A * | 7/1973 | Hathaway et al. | 109/49.5 |
| 4,475,248 | A * | 10/1984 | L'Abbe et al. | 2/2.5 |
| 4,782,735 | A * | 11/1988 | Mui et al. | 89/36.07 |
| 5,241,703 | A * | 9/1993 | Roberts et al. | 2/2.5 |
| 5,463,929 | A | 11/1995 | Mejia | |
| 5,641,934 | A * | 6/1997 | Follett | 89/36.05 |
| 5,669,174 | A * | 9/1997 | Teetzel | 42/115 |
| 5,797,140 | A | 8/1998 | Davis et al. | |
| 5,850,052 | A * | 12/1998 | Gabriel | 89/36.05 |
| 6,367,943 | B1 | 4/2002 | Tocci et al. | |
| 6,389,949 | B1 | 5/2002 | Carreira | |
| 6,807,890 | B1 * | 10/2004 | Fuqua | 89/36.02 |
| 6,886,446 | B1 | 5/2005 | Baker | |
| 6,941,585 | B2 | 9/2005 | Wells, Jr. | |
| 7,302,880 | B1 * | 12/2007 | Elasic | 89/36.07 |
| 7,594,515 | B2 * | 9/2009 | Prock | 135/117 |
| 7,716,748 | B2 * | 5/2010 | Dovner | 2/2.5 |
| 7,770,505 | B2 * | 8/2010 | McClellan et al. | 89/36.06 |
| 2002/0092416 | A1 | 7/2002 | Cohen et al. | |
| 2003/0110933 | A1 | 6/2003 | Baker | |
| 2004/0144244 | A1 | 7/2004 | Sargent | |
| 2004/0255769 | A1 | 12/2004 | Drackett | |
| 2005/0217472 | A1 | 10/2005 | Baker | |
| 2006/0230916 | A1 | 10/2006 | Sand | |
| 2007/0131103 | A1 | 6/2007 | McClellan et al. | |
| 2007/0193441 | A1 | 8/2007 | Carter | |
| 2007/0283477 | A1 | 12/2007 | Dovner | |
| 2007/0295199 | A1 | 12/2007 | Elasic | |
| 2008/0087684 | A1 * | 4/2008 | Koshimoto | 222/192 |
| 2010/0083820 | A1 * | 4/2010 | Doyner et al. | 89/36.02 |

* cited by examiner

*Primary Examiner* — Michael David
(74) *Attorney, Agent, or Firm* — Howard & Howard Attorneys PLLC

(57) ABSTRACT

A shield apparatus which is aimed at providing advanced protection for first incident responders is disclosed. The shield apparatus includes a transparent shield portion which has an outer edge. A trim portion made of a flexible material is affixed to the outer edge of the transparent shield portion. An On/Off switch actuates two flood lights which are controlled via separate circuits for reliability purposes. Dual handles, plus a detachable shoulder strap may also be provided. Video camera, thermal imaging sensors/camera and alternative lighting, including infrared, may also be provided.

24 Claims, 15 Drawing Sheets

PROTECTIVE SHIELD APPARATUS

CROSS-REFERENCE TO RELATED APPLICATIONS

The present application is a continuation of U.S. Non-Provisional patent application Ser. No. 12/967,941, filed Dec. 14, 2010 now abandoned, which is a continuation of U.S. Non-Provisional patent application Ser. No. 12/784,261, filed May 20, 2010 (now abandoned), which claims priority to U.S. Provisional Patent Application Ser. No. 61/216,912, filed May 21, 2009, the entire disclosure of which are hereby incorporated by reference.

BACKGROUND OF THE INVENTION

First incident responders are being attacked by individuals specifically targeting their heads, faces and necks.

It is our uniformed patrol and security forces that face the greatest threats, because they are on duty every day, yet they have the least amount of protective equipment.

The three most deadly situations faced by Law Enforcement Officers are the Traffic Stop, Domestic Violence call and Unknown Trouble/Check Subject call. However, these officers working uniformed patrol do not have any protection that is immediately available to them as they approach potentially deadly situations.

Ballistic vests do not protect the head, face or neck.

Ballistic vests do not protect against edged weapon attacks.

All law enforcement officers; Federal, State and local are faced with potentially deadly challenges during every call for service. They are called upon to immediately respond to violent threats; i.e.: School Shootings, Barricaded Gunman, Bomb Threats . . . . Setting up a perimeter around the area, while waiting for Special Tactics Teams to arrive is no longer appropriate or acceptable. The general public now expects and demands that our First Incident Responders be equipped, trained and react to all Active Violent Incidents (AVI), without delay.

Gang members, armed criminals, emotionally violent offenders and terrorists have targeted Law Enforcement officers with more sophisticated equipment, tactics and training. Prison inmates, gang members and terrorists have been observed training and communicating on how to take out our countries first incident responders. Information that gang members have been communicating that if confronted by the police, to "shoot at the white triangle". This "white triangle" is referring to the patch of white t-shirt that shows at the officer's neck. Basically, they are training to shoot officers in the head, face, or neck. Armed assailants, criminals and most civilians understand that police officers wear ballistic vests. This "common knowledge", has increasingly created a more lethal work environment for our countries law enforcement officers. Additionally, information has been intercepted that another tactic is lure police officers into an area where Molotov Cocktails can be used against them.

Patrol duty has always left officers at a great disadvantage, because of the reactive nature of police work. In an instant, officers are required to make split second, life or death decisions, based on what the other person does or doesn't do. From traffic stops, to school shootings, to gang fights, to armed robberies; officers can only react. Often times the split second between perceiving a dangerous situation and then reacting to it, is not enough time to think. You can only react, instinctively and hopefully the right response was made.

Current ballistic police shields available on the market are designed for special tactical and rescue teams and not the uniformed patrol officer. Thus, they are not designed for the unique situations officers respond to on a daily basis. They are large, bulky, not transparent, and don't have adequate lighting capabilities for the situations officers find themselves on during every shift of duty.

In summary, the problem is that our Uniformed Patrol Officers have never had any protective device that offered Ballistic, Edged Weapon, Explosive protection for their heads, faces and necks that was immediately available to them during the normal course of their daily duties. Note: (1) a growing segment of our society is educated, equipped and trained for the purpose of attacking our police officers, on a daily basis; (2) officers are now required to respond to Active Violent Incidents, immediately, where past practice was to wait for Specially Trained and Equipped Teams; (3) Ballistic vests are great, however they no longer provide adequate protections; and (4) the reactive nature of police work only allow for split second reactions to potentially deadly threats. These problems face every Law Enforcement Officer, Security Guard and First Incident Responder during every call, of every shift, during every day they are on patrol.

No one has attempted to solve the problem of providing a Ballistic, Explosive and Edged Weapons Resistant Protective Shield for Law Enforcement/First Incident Responders, which would be readily available for use during every shift, traffic stop, and call for service. Some have a window in them, and some have a light on them, however they are shields sold for use by special tactics, entry and rescue teams. Their use is not for patrol duty, but for special calls for service. Further, these shields do not address the problems of Edged Weapons, Explosive Devices or Incinerator/Flammable Devices Attacks.

No one has addressed the Uniformed Patrol Officer or Uniformed Security Guard that is on patrol and in need of immediate ballistic/edged weapon protection during their "routine" patrol duties with a protective device for their heads, faces and necks.

The present ballistic police shields are designed for Special Tactical and Rescue Teams, are not transparent, and fail to protect the officer's head, face or neck.

The ballistic "bunkers" or podiums are so heavy they have to be rolled into place, making them useless for everyday patrol duty.

The shields that have a window in them seriously reduce the field of vision, creating a dangerous situation for the officer and public, because the officer is unable to adequately see the entire threat.

The lighting provided on present ballistic shields is located on the outside of the shield, exposing them to attack. Without adequate lighting Officer's are unable to respond correctly.

Ballistic vests worn by Officers do not protect against attacks to their heads, faces or necks.

Prior solutions do not address the threats against edged weapons, explosive or incinerator/flammable device attacks.

The present invention is aimed at one or more of the problems set forth above.

SUMMARY OF THE INVENTION

In a first aspect of the invention, a protective apparatus is provided. The protective apparatus includes a shield portion, a trim portion, a light providing mechanism, a first energy storage device, and a second energy storage device. The shield portion has an outer edge, a front and a rear surface. The shield portion is composed of a transparent material. The trim portion is made of a flexible material affixed to the outer edge of the shield portion. The trim portion has an outer rim.

A channel is formed in the outer rim. The light providing mechanism is coupled to the rear surface of the shield portion. The light providing device includes a first lighting device and a second lighting device. The first energy storage device is electrically coupled to the first lighting device for providing electrical power thereto. The second energy storage device is electrically coupled to the second lighting device for providing electrical power thereto. The first and second energy storage devices are independent.

In a second aspect of the present invention, a protective apparatus is provided. The protective apparatus includes a shield portion, a support structure, a handle, a trim portion, a light housing, a light providing mechanism, a protective lens, a first energy storage device, and a second energy storage device. The shield portion has an outer edge, a front surface, and a rear surface. The shield portion is composed of a transparent material. The support structure is fixed to the rear surface of the transparent shield portion. The support structure has a rear surface. The handle is fixed to the rear surface of the support structure. The trim portion is made of a flexible material and is affixed to the outer edge of the shield portion. The trim portion has an outer rim. A channel is formed in the outer rim. The light housing is coupled to the rear surface of the support structure. The light housing has an opening facing the support structure. The light providing mechanism is coupled to the rear surface of the shield portion and is contained within the light housing. The light providing device includes a first lighting device and a second lighting device. The protective lens is coupled to the opening. The support structure has one or more apertures. The protective lens is located behind the apertures. The first energy storage device is electrically coupled to the first lighting device for providing electrical power thereto. The second energy storage device is electrically coupled to the second lighting device for providing electrical power thereto. The first and second energy storage devices are independent.

In a third aspect of the present, a protective apparatus in the form of a shield is provided.

Transparent, lightweight protective shields designed for uniformed patrol duty, providing ballistic, edged weapon, explosive protective above the ballistic vest, during "routine patrol".

Officers only have a split second to identify potential threats, and then respond to them appropriately, considering the level of the threat and any potential innocent bystanders. Depicted in this picture an officer checking a suspicious subject would have immediate protection to the head, face and neck as he is able to determine the threat level.

It is our uniformed patrol officers and security guards who are in greater need of advanced protection, because they are on the job every day. The three most dangerous routine patrol activities of law enforcement officers are the traffic stop, domestic violence call and check unknown subject.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1A:
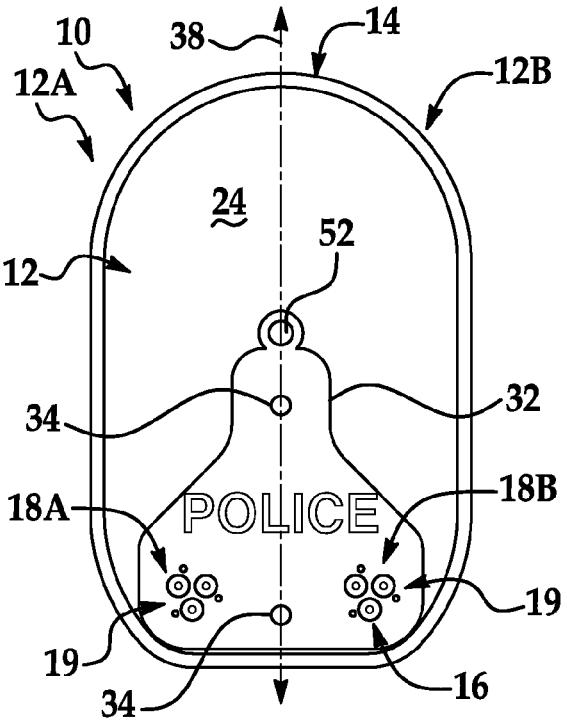
FIG. 1A is a front view of a protective apparatus, according to a first embodiment of the present invention.
Figure 1B:
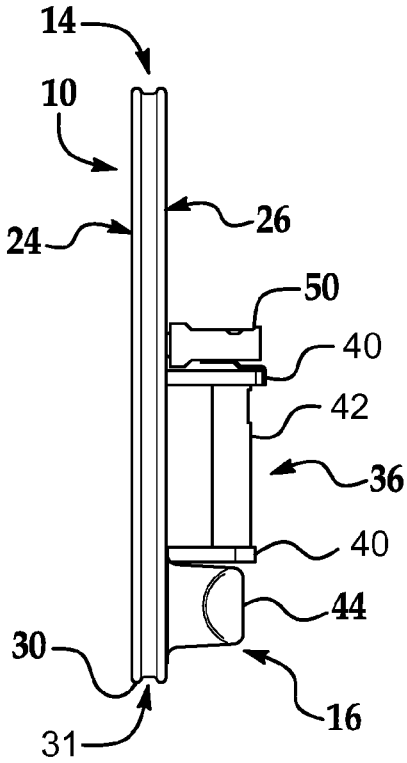
FIG. 1B is a side view of the protective apparatus of FIG. 1A.
Figure 1C:
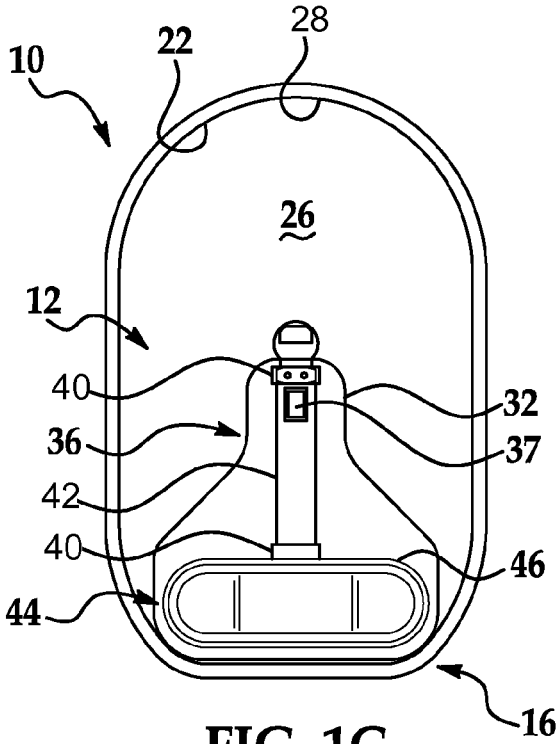
FIG. 1C is a rear view of the protective apparatus of FIG. 1A.
Figure 1D:
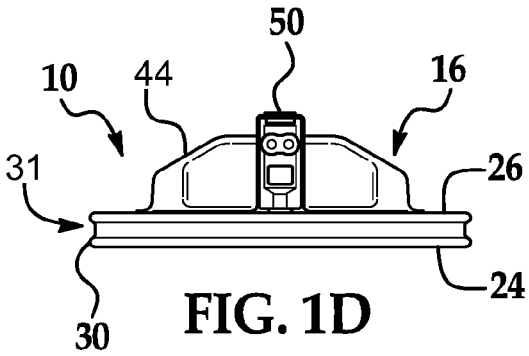
FIG. 1D is a top view of the protective apparatus of FIG. 1A.
Figure 1E:
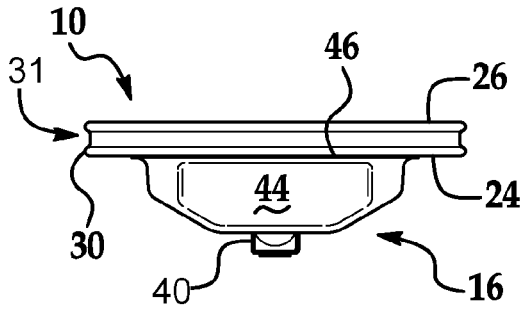
FIG. 1E is a bottom view of the protective apparatus of FIG. 1A.
Figure 1F:
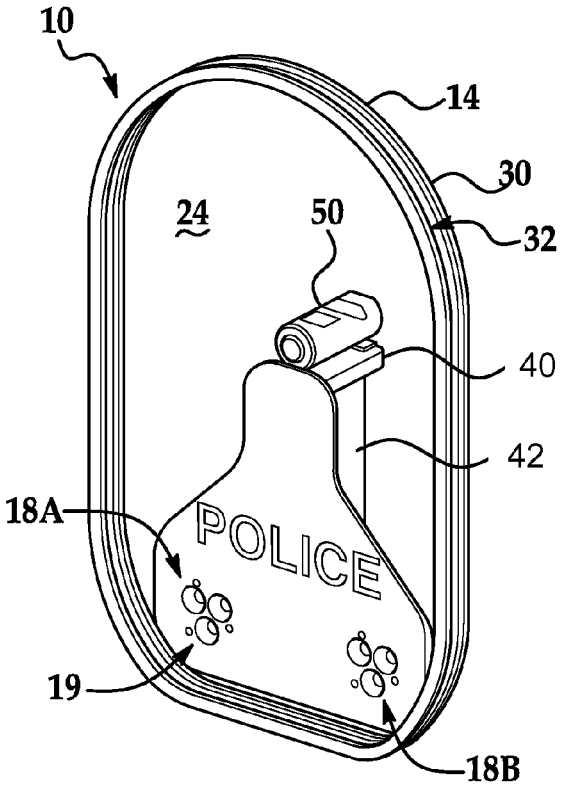
FIG. 1F is a first isometric view of the protective apparatus of FIG. 1A.
Figure 1G:
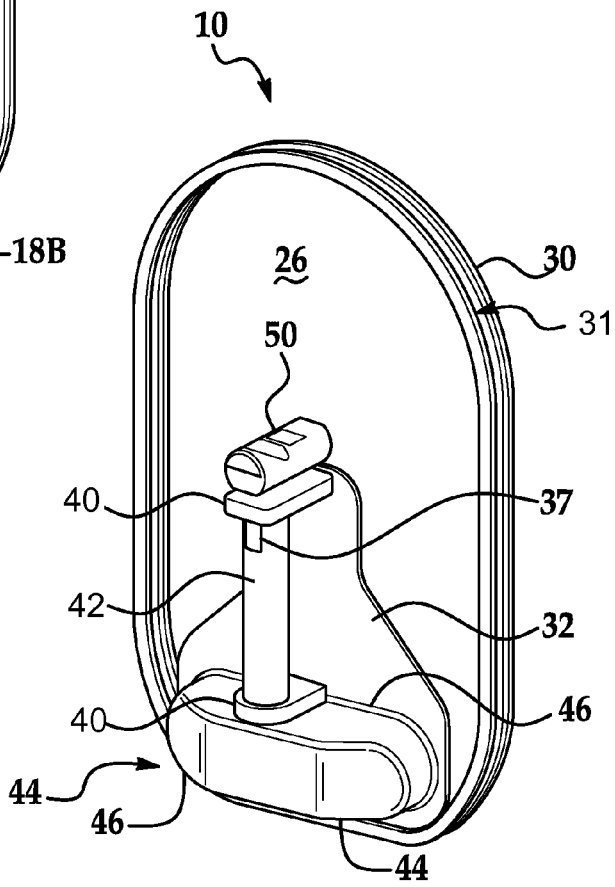
FIG. 1G is a second isometric view of the protective apparatus of FIG. 1A.
Figure 2:
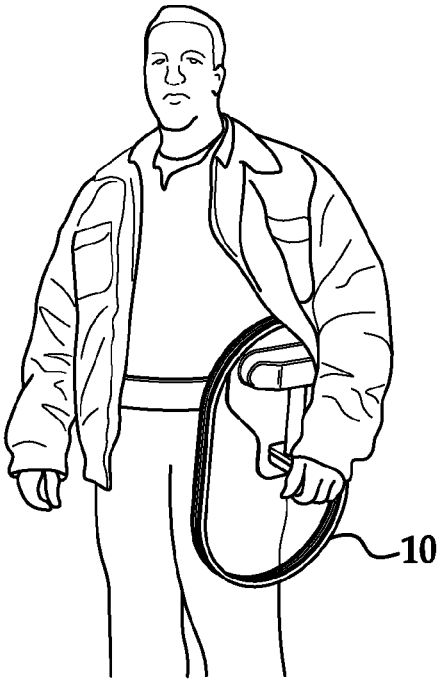
FIG. 2 is a first view of the protective apparatus of FIG. 1A in use.
Figure 3:
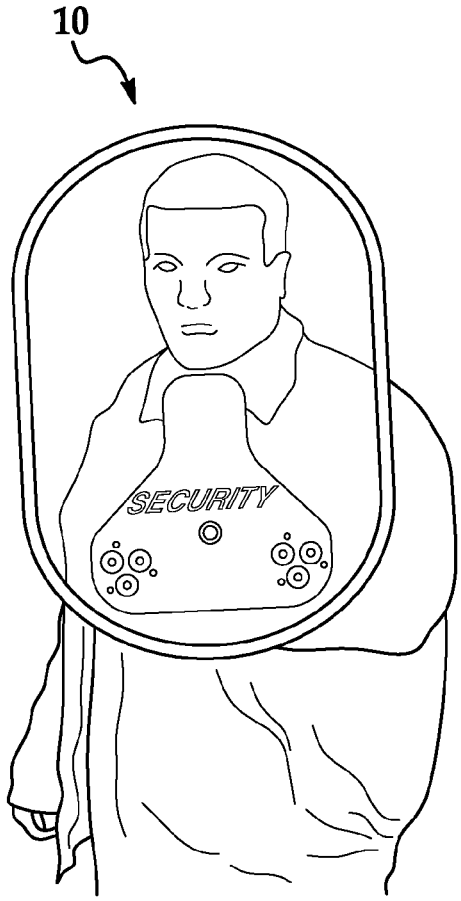
FIG. 3 is a second view of the protective apparatus of FIG. 1A in use.
Figure 4:
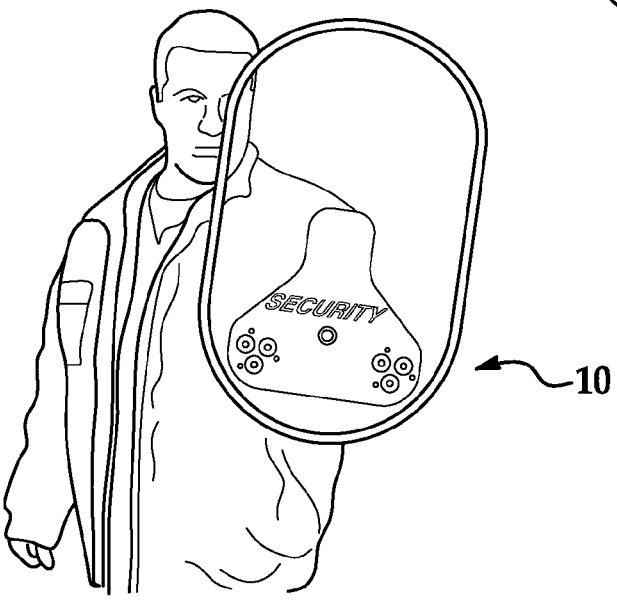
FIG. 4 is a third view of the protective apparatus of FIG. 1A in use.
Figure 5:
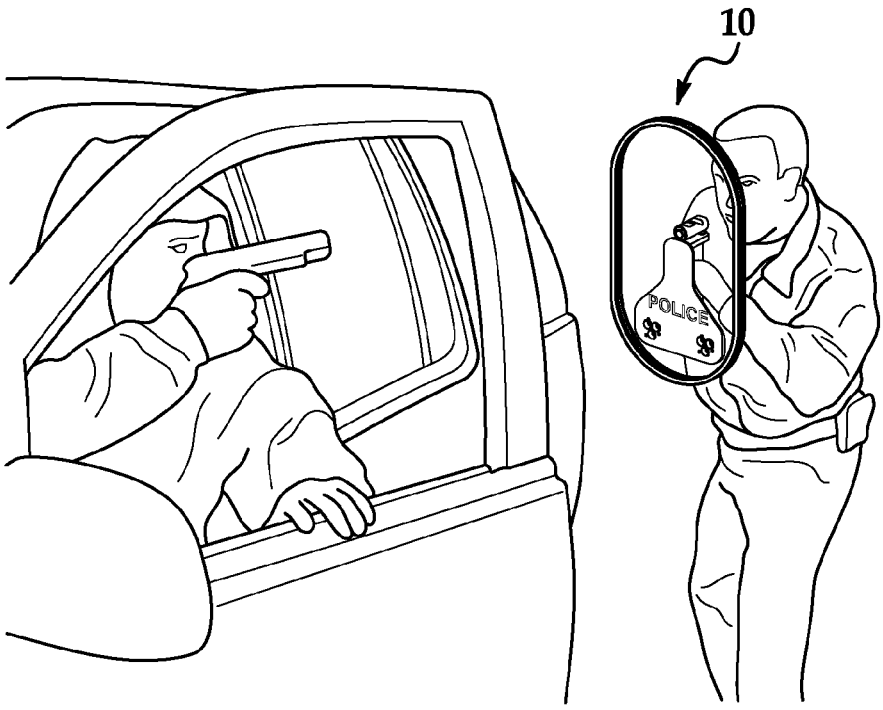
FIG. 5 is a fourth view of the protective apparatus of FIG. 1A in use.
Figure 6:
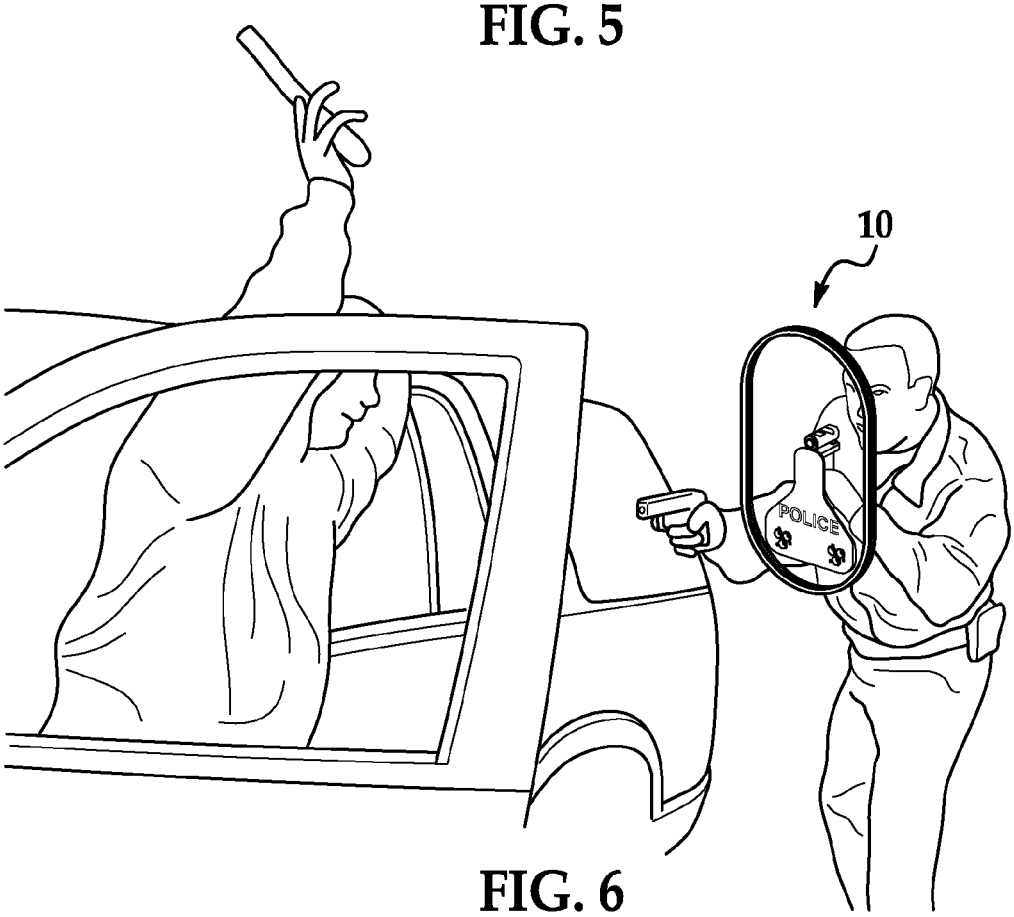
FIG. 6 is a fifth view of the protective apparatus of FIG. 1A in use.
Figure 7:
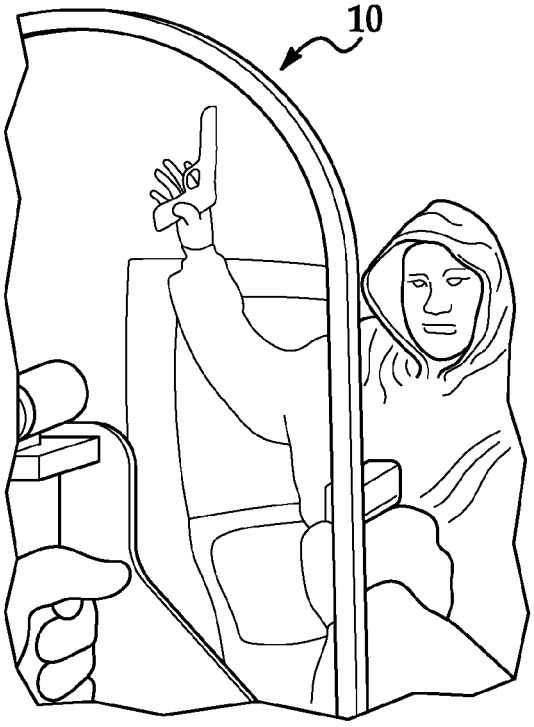
FIG. 7 is a sixth view of the protective apparatus of FIG. 1A in use.
Figure 8A:
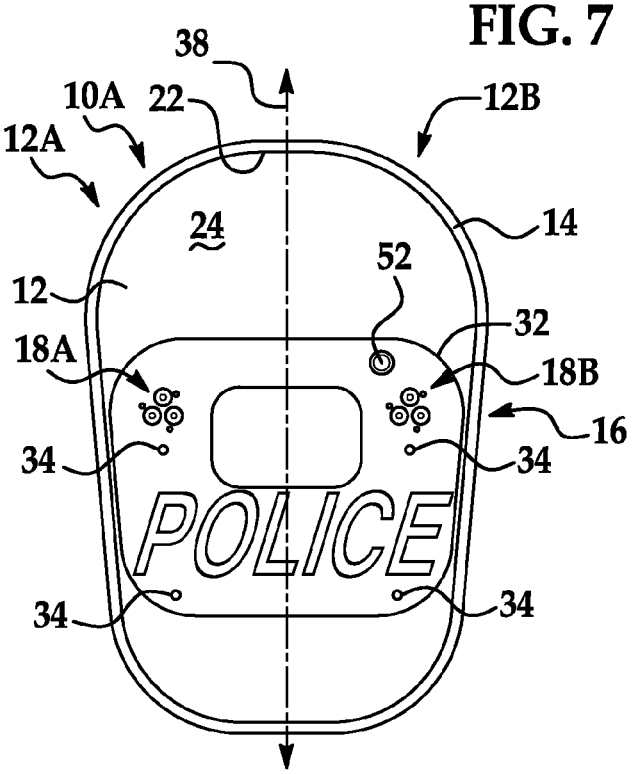
FIG. 8A is a front view of a protective apparatus, according to a second embodiment of the present invention.
Figure 8B:
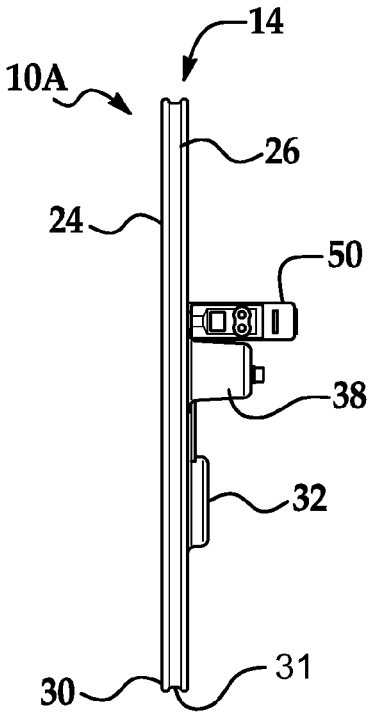
FIG. 8B is a side view of the protective apparatus of FIG. 8A.
Figure 8C:
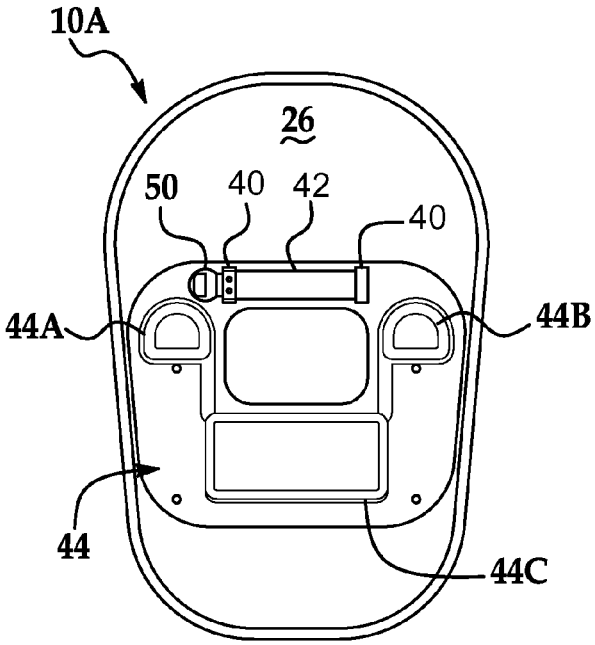
FIG. 8C is a rear view of the protective apparatus of FIG. 8A.
Figure 8D:
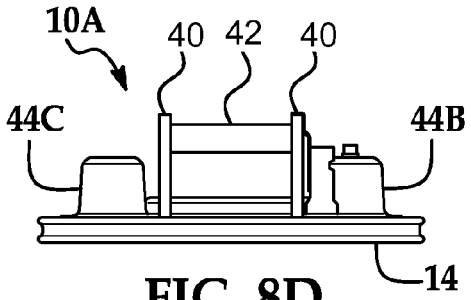
FIG. 8D is a top view of the protective apparatus of FIG. 8A.
Figure 8E:
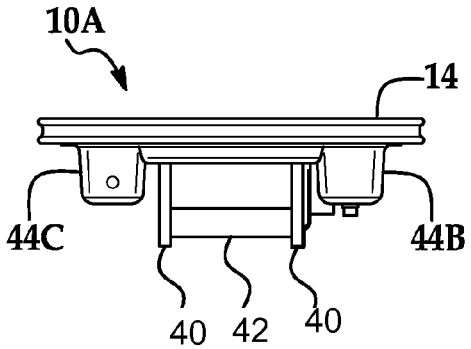
FIG. 8E is a bottom view of the protective apparatus of FIG. 8A.
Figure 8F:
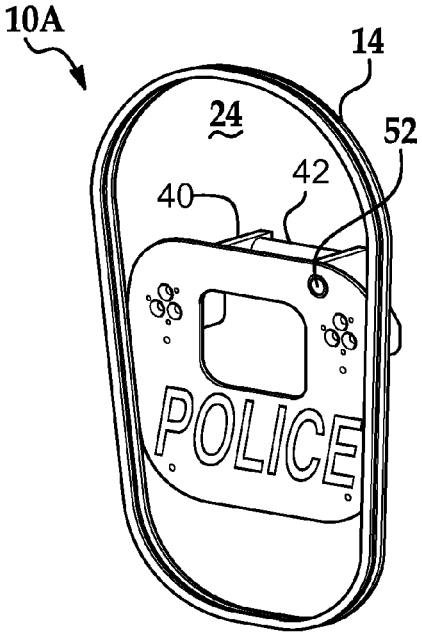
FIG. 8F is a first isometric view of the protective apparatus of FIG. 8A.
Figure 8G:
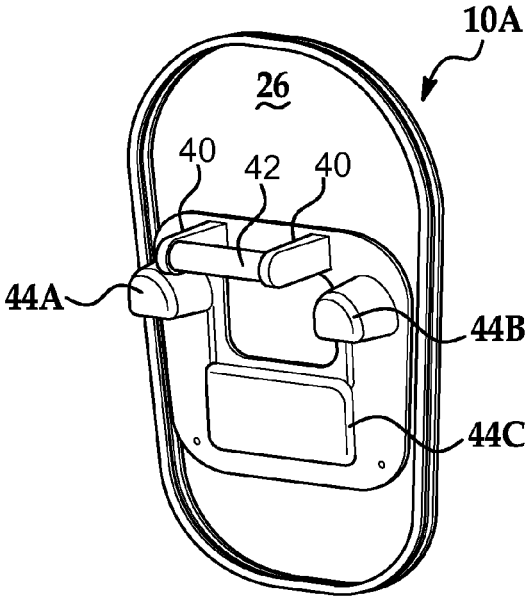
FIG. 8G is a second isometric view of the protective apparatus of FIG. 8A.
Figure 9A:
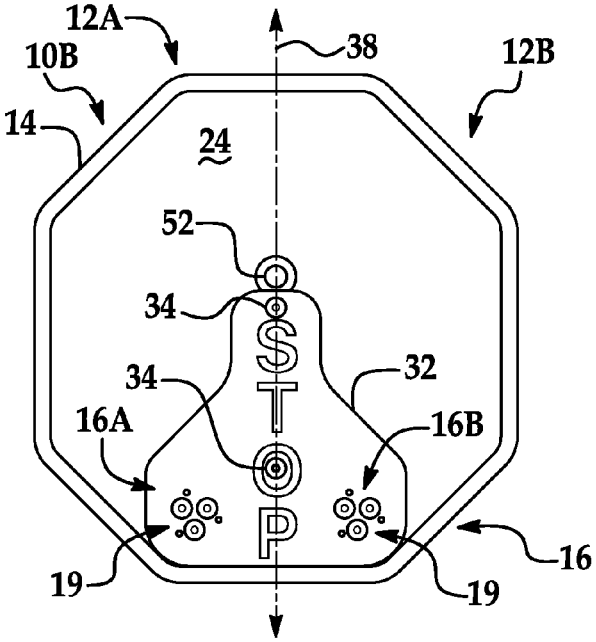
FIG. 9A is a front view of a protective apparatus, according to a third embodiment of the present invention.
Figure 9B:
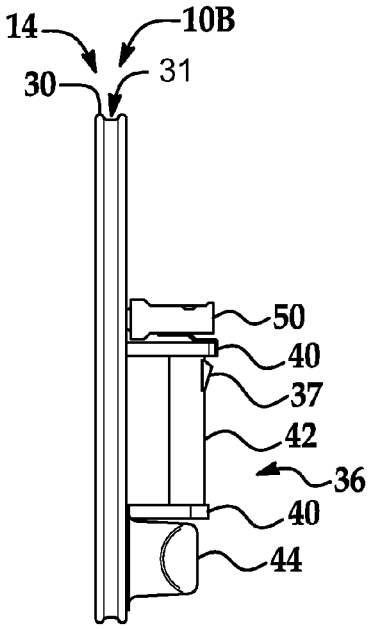
FIG. 9B is a side view of the protective apparatus of FIG. 9A.
Figure 9C:
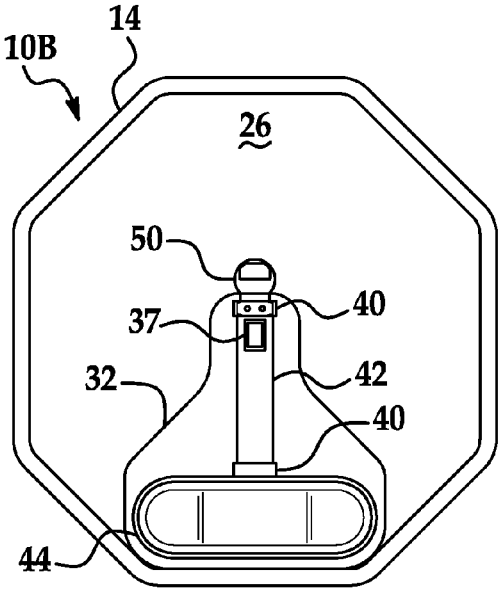
FIG. 9C is a rear view of the protective apparatus of FIG. 9A.
Figure 9D:
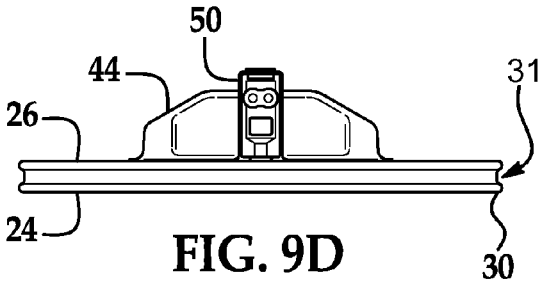
FIG. 9D is a top view of the protective apparatus of FIG. 9A.
Figure 9E:
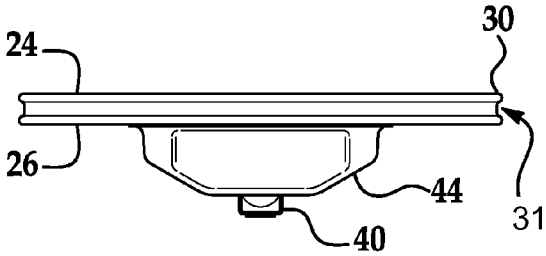
FIG. 9E is a bottom view of the protective apparatus of FIG. 9A.
Figure 10:
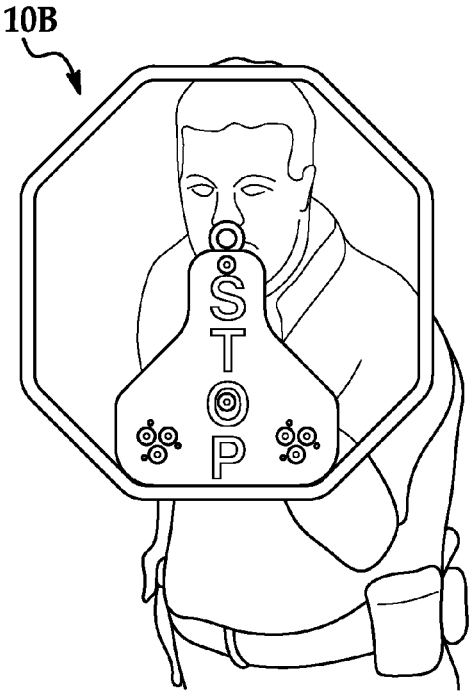
FIG. 10 is a view of the protection apparatus of FIG. 9A in use.
Figure 11A:
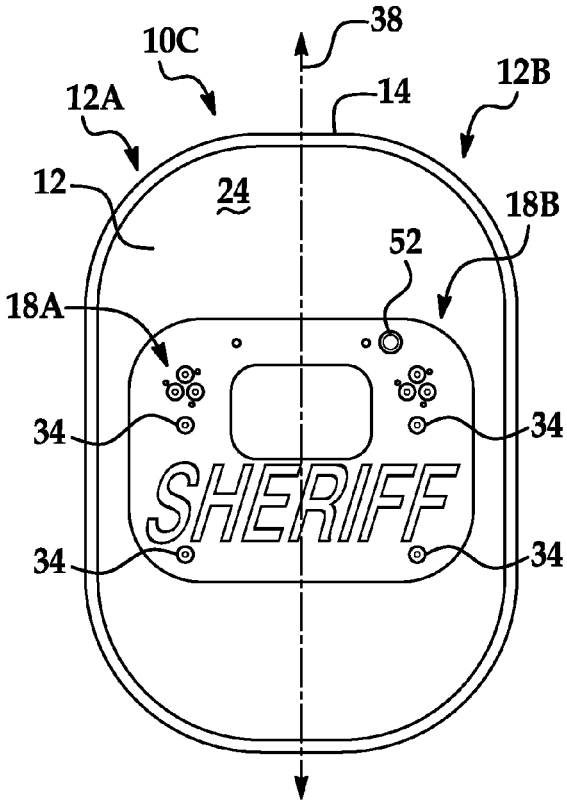
FIG. 11A is a front view of a protective apparatus, according to a fourth embodiment of the present invention.
Figure 11B:
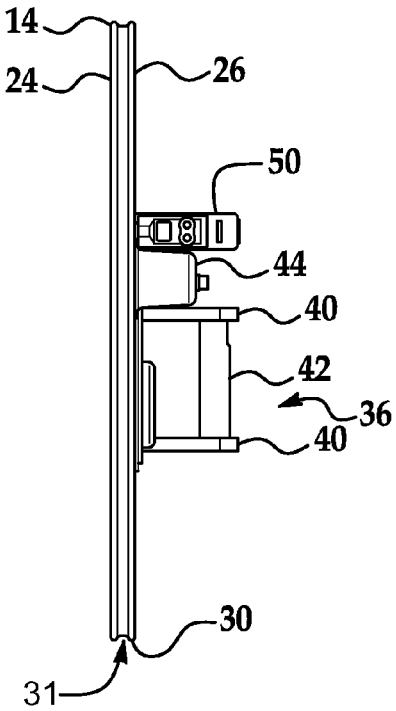
FIG. 11B is a side view of the protective apparatus of FIG. 11A.
Figure 11C:
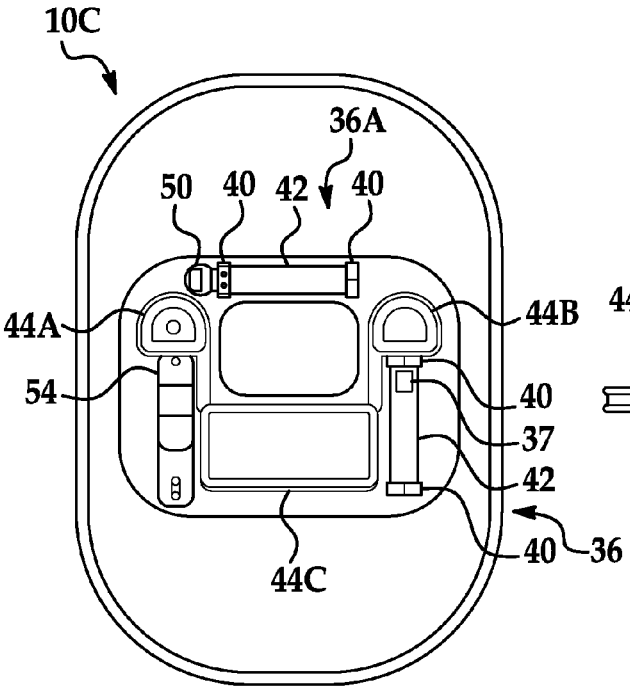
FIG. 11C is a rear view of the protective apparatus of FIG. 11A.
Figure 11D:
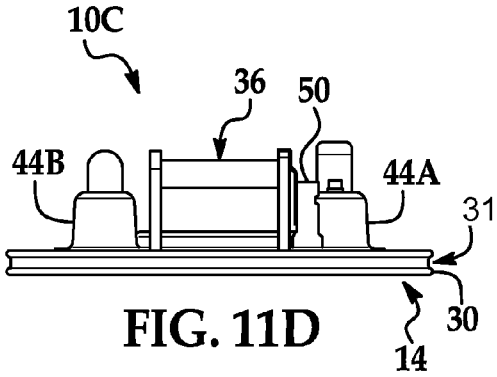
FIG. 11D is a top view of the protective apparatus of FIG. 11A.
Figure 11E:
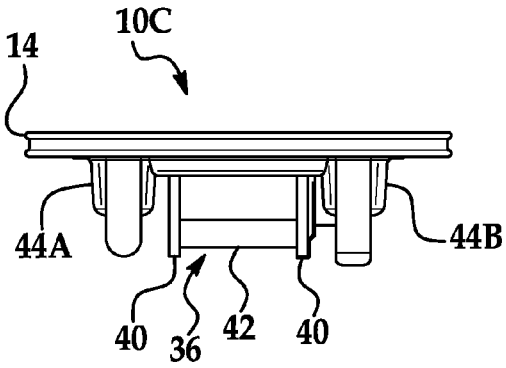
FIG. 11E is a bottom view of the protective apparatus of FIG. 11A.
Figure 11F:
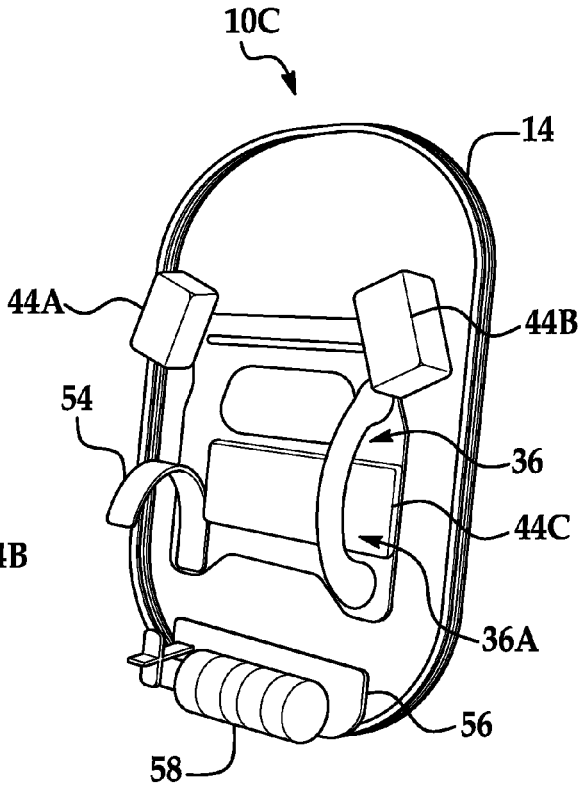
FIG. 11F is an isometric view of the protective apparatus of FIG. 11A.
Figure 12:
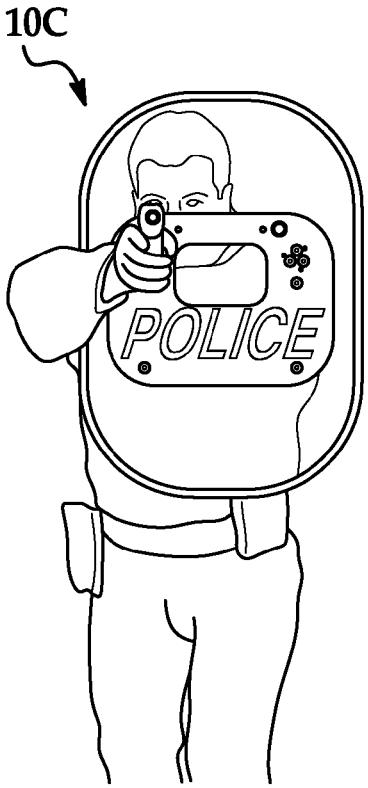
FIG. 12 is a view of the protection apparatus of FIG. 11A in use.
Figure 13:
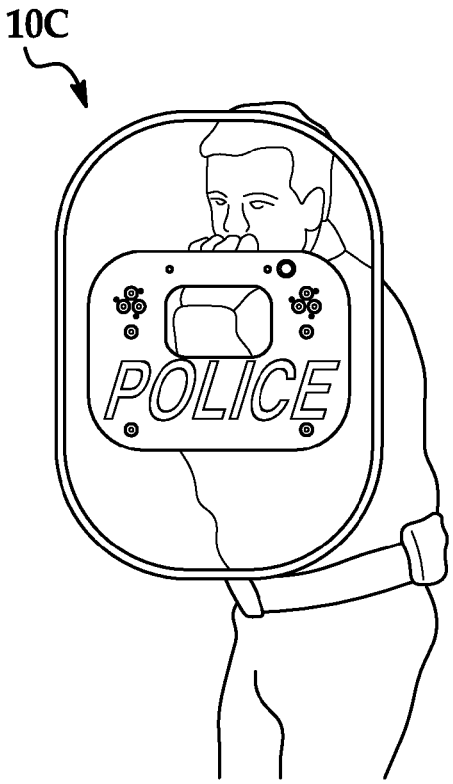
FIG. 13 is a view of the protection apparatus of FIG. 11A in use.
Figure 14:
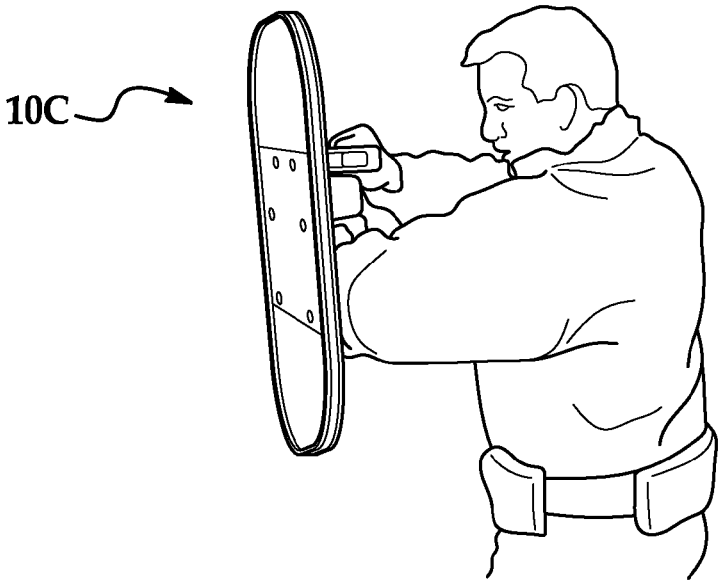
FIG. 14 is a view of the protection apparatus of FIG. 11A in use.
Figure 15A:
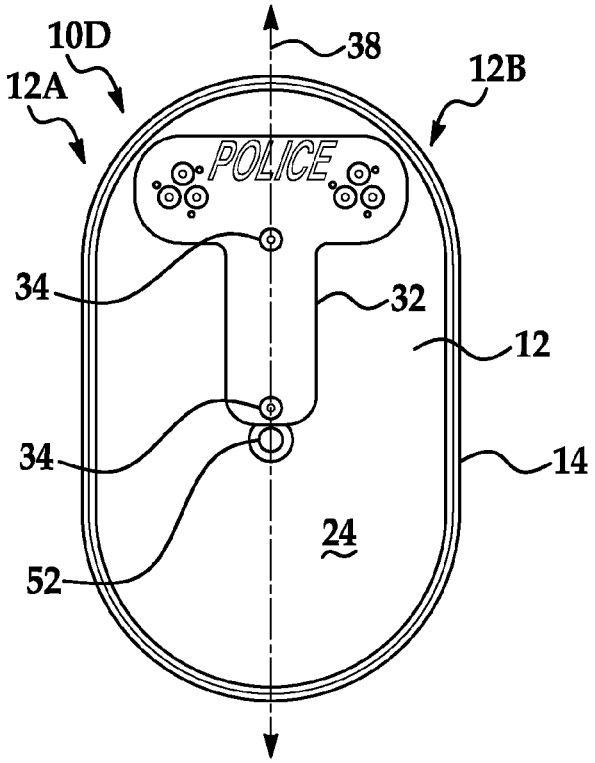
FIG. 15A is a front view of a protective apparatus, according to a fifth embodiment of the present invention.
Figure 15B:
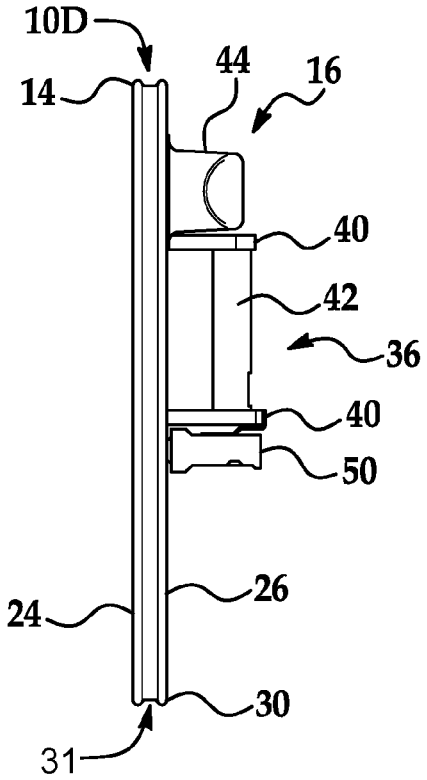
FIG. 15B is a side view of the protective apparatus of FIG. 12A.
Figure 15C:
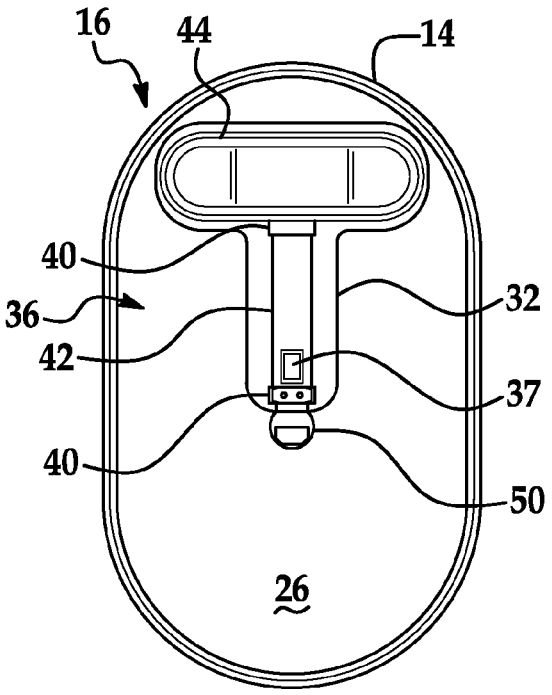
FIG. 15C is a rear view of the protective apparatus of FIG. 12A.
Figure 15D:
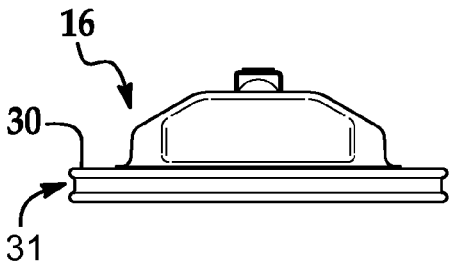
FIG. 15D is a top view of the protective apparatus of FIG. 12A.
Figure 15E:
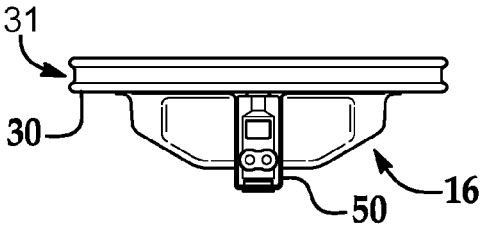
FIG. 15E is a bottom view of the protective apparatus of FIG. 12A.

With reference to the drawings, and in operation, a protective apparatus 10 is provided. In one aspect, the protective apparatus 10 is provided as a personal shield, sold under the trade name, Cide Shield™.

With respect to FIGS. 1A, 1B, 1C, 1D, 1E, 1F, 1G, and 16, a first embodiment of the present invention is shown. The protective apparatus 10 includes a shield portion 12, a trim portion 14, a light providing mechanism 16, a first energy storage device 20A, and a second energy storage device 20B.

The shield portion 12 has an outer edge 22, a front surface 24, and a rear surface 26. The shield portion 12 is composed of a transparent material, such as a polycarbonate and/or acrylic sheet material. In one embodiment, the transparent material is a three-ply laminate sheet sold under the name Lexgard® HP875 laminate available from the General Electric Company.

The trim portion 14 is made of a flexible material affixed to the outer edge 22 of the shield portion 12.

In one embodiment, the trim portion 14 is unitarily formed and has an interior channel 28. The trim portion 14 is stretched over the shield portion 12 such that the outer edge 22 of the shield portion 12 is contained within the interior channel 28. The trim portion 14 may be additionally, or alternatively, glued or affixed to the outer edge 22 of the shield portion by an adhesive.

The trim portion 14 has an outer rim 30. A channel 31 is formed in the outer rim 30. The channel 31 allows two or more of the protective apparatuses 10 to be temporarily linked together by placing them next together with their channels interlinked. This creates a larger protective barrier which can be easily constructed on an as needed basis.

The light providing mechanism 16 is coupled to the rear surface 26 of the shield portion 12.

In the illustrated embodiment, the light providing device 16 includes a first lighting device 18A and a second lighting device 18B. The first energy storage device 20A is electrically coupled to the first lighting device 18A for providing electrical power thereto. The second energy storage device 20B is electrically coupled to the second lighting device 18A for providing electrical power thereto. The first and second energy storage devices 20A, 20B are independent (see below).

In one embodiment, of the present invention, the protective apparatus 10 includes a support structure 32. The support structure 32 is fixed to the rear surface 26 of the transparent shield portion 12. In the illustrated embodiment, the support structure 32 is fixed to the shield portion 12 by one or more bolts 34.

The protective apparatus 10 may include one more handles 36. In the illustrated embodiment, the protective apparatus 10 includes a single handle 36 which is parallel to a vertical axis 38. In the illustrated embodiment, the handle 36 includes two posts 40 mounted to the support structure 32 and extending in a rearward direction and a grip portion 42 mounted there between.

A switch 37 for turning the light providing device on and off may be provided in the handle 36.

Figure 16:
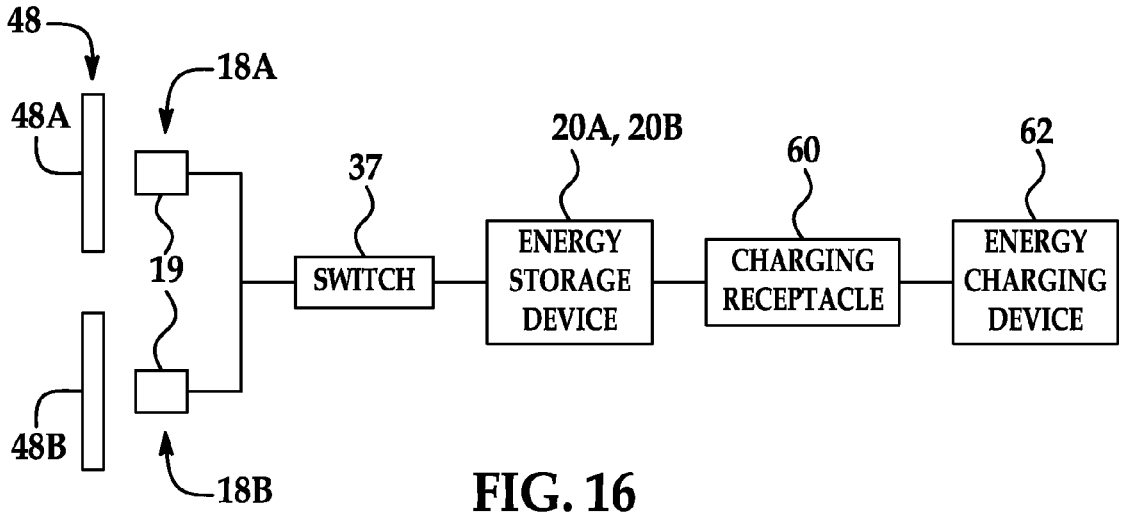
FIG. 16 is a block diagram of a lighting providing device for use with a protective apparatus, according to an embodiment of the present invention.
Figure 17A:
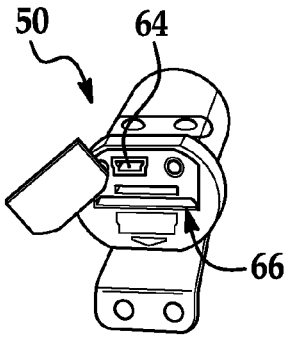
FIG. 17A is a first view of a video camera for use with a protective apparatus, according to an embodiment of the present invention.
Figure 17B:
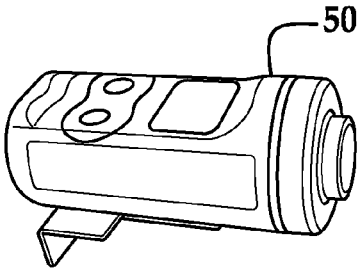
FIG. 17B is a second view of the video camera of FIG. 17A.
Figure 18:
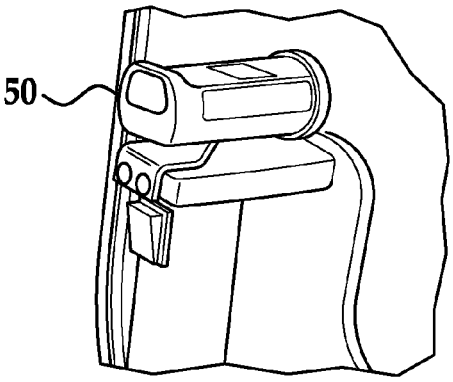
FIG. 18 is a third view of the video camera of FIG. 17A.
Figure 19:
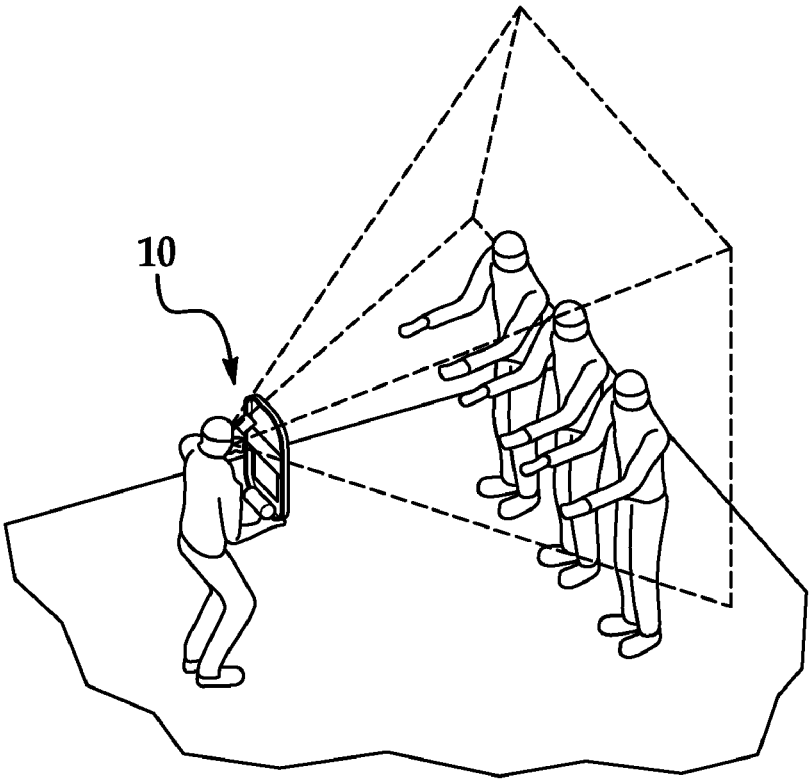
FIG. 19 is a first illustrative diagram of a protective apparatus according to an embodiment of the present invention.
Figure 20:
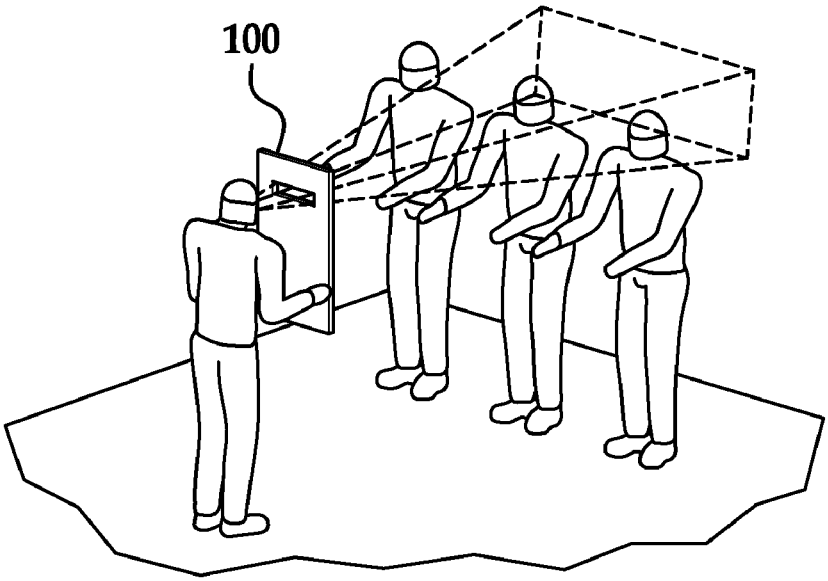
FIG. 20 PRIOR ART
FIG. 20 is a diagrammatic diagram of a prior art apparatus in use.
Figure 21:
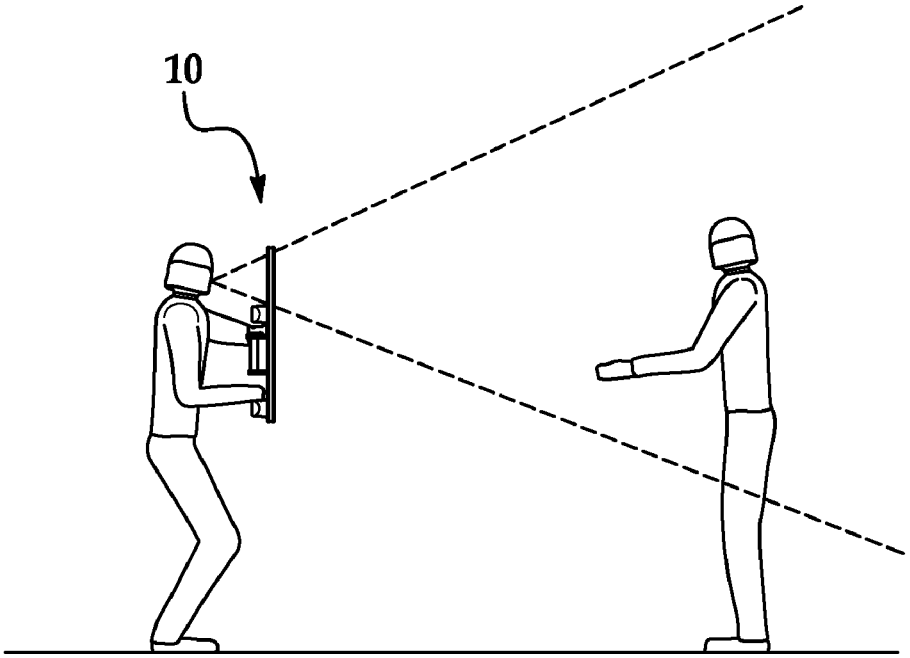
FIG. 21 is a second illustrative diagram of a protective apparatus according to an embodiment of the present invention.
Figure 22:
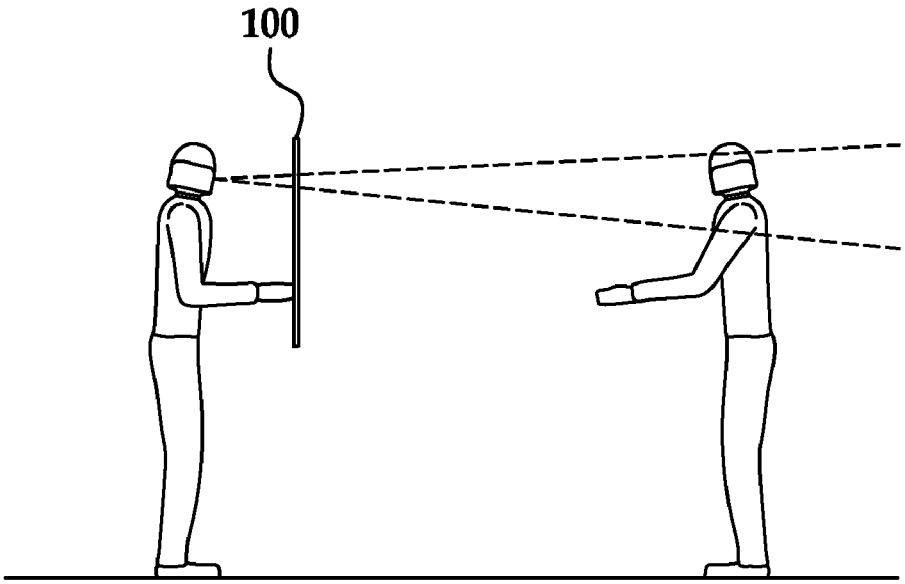
FIG. 22 PRIOR ART
FIG. 22 is a diagrammatic diagram of a prior art apparatus in use.
Figure 23:
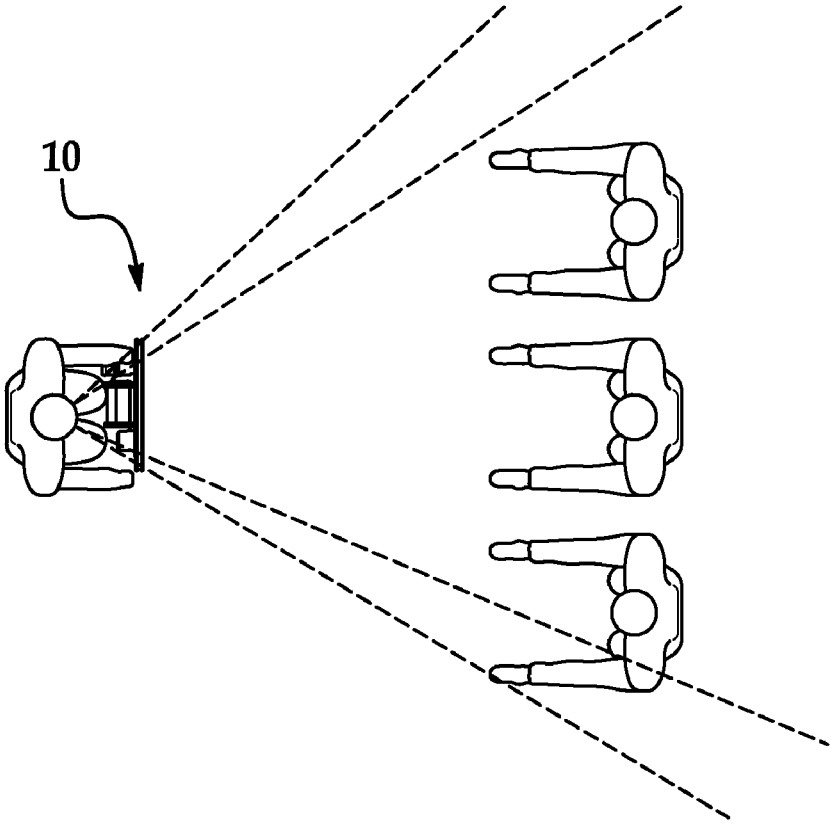
FIG. 23 is a third illustrative diagram of a protective apparatus according to an embodiment of the present invention; and, FIG. 24 is a diagrammatic diagram of a prior art apparatus in use.
Figure 24:
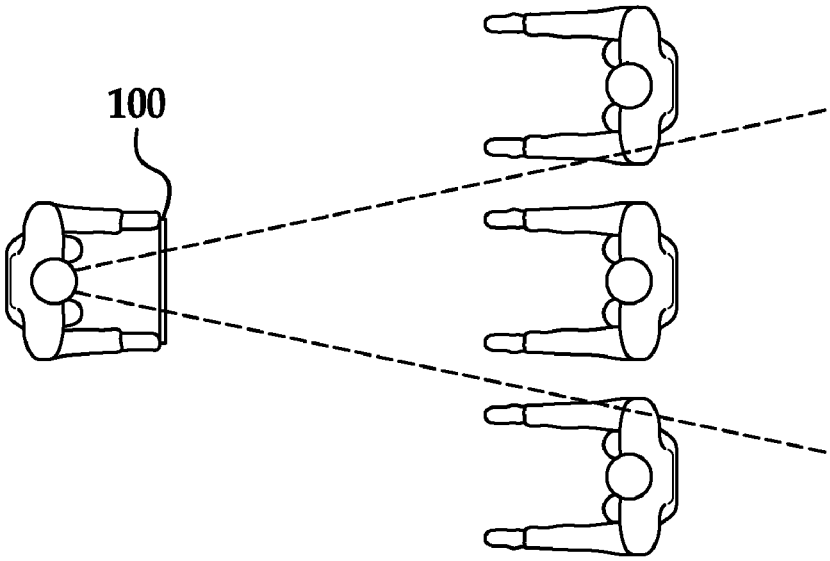
FIG. 24 PRIOR ART

The protective apparatus 10 may include a light housing 44 coupled to the rear surface 26 of the shield portion 12. The light housing 44 has an opening 46 which faces the shield portion 12. The light providing mechanism 16 is contained within the light housing 44. With reference to FIG. 16, a protective lens 48 is coupled to the opening 46. The light providing device 16 is located behind the protective lens 48.

In the illustrated embodiment, the shield portion 12 has a first side portion 12A and a second side portion 12B.

In one embodiment, the first lighting device 18A is located on the first side portion 12A of the shield portion 12 and the second lighting device 18B is located on the second side portion 12B of the shield portion 12.

Since the first energy storage device 20A provides power to the first lighting device 18A and the second energy device 20B provides power to the second lighting device 18B, if there is a malfunction of one of the storage devices 20A, 20B, the other may still work, thereby providing energy to the other light device 18A, 18B.

In another embodiment, each lighting device 18A, 18B includes multiple lighting elements 19. All of the lighting elements 19 associated with one of the lighting devices 18A, 18B may be located on one side or the other 12A, 12B. Alternatively, one or more of the lighting elements 19 associated with one of the lighting device 18A, 18B, may be located on side 12A, 12B and the other lighting elements 19 associated with the one lighting device 18A, 18B may be located on the other side 12A, 12B.

In one embodiment, a video camera 50 may be removably mounted behind the shield portion 12. In the illustrated embodiment, the video camera 50 may include a USB port 64 and/or memory card reader 66 for storing and/or downloading pictures and/or video from the video camera 50.

In the illustrated embodiment, the video camera 50 may be located behind an upper portion of the support structure 32. The support structure 32 may include an aperture 52 such that the video camera 50 can capture images and/or video.

CiDe Shields™ products are designed to offer protection from ballistic, edged weapon, explosive and incendiary device attacks. They are completely transparent and distortion free, allowing first incident responders to remain behind cover at all times. Significantly increasing their ability to assess situations, identify potential threats, scan for innocent bystanders, and then respond with greater confidence.

Five different CiDe Shield™ designs have been developed for the various divisions and situations faced by our first incident responders, as described below. It should be noted that additional variations and shields may also be developed.

Officer Shields

As shown in FIGS. 1A through 1G, an officer shield 10 may have outer dimensions of approximately 12.0×20.0 inches and weigh approximately 10 pounds. This rectangular, lightweight shield is designed for easy use, increased visibility and maximum protection during every day "routine patrol duties". Protecting our responders during the calls and situations that are most dangerous; that being the domestic violence call, traffic stop, and trouble with subject/unknown trouble call. Use of the officer shield 10 is illustrated in FIGS. 2-7.

Active Violent Incident (AVI) Shields

With reference to FIGS. 8A-8G, in which similar reference numbers are used, an AVI shield 10A may have outer dimensions of approximately 16.25×24.5 inches and weigh approximately 15.0 pounds. The AVI Shield 10A is a lighter and larger version of the patrol shield (see below) that would allow several officers to be protected, as they enter funnel situations and check large areas for identified threats. The AVI Shield 10B is approximately 25% lighter than the Patrol shield and may include a horizontal or vertical handle placement and provide the same advanced features.

Border Shields

With reference to FIGS. 9A, 9B, 9C, 9D, 9E, and 10, in which similar reference numbers are used for like parts, a border shield 10B may have an octagonal outer shield with an approximate 17 inch diameter and weigh approximately 10.5 pounds. The border shield 10B provides the same protective qualities and components as the Officer Shield 10; however that added octagon design component provides that universally recognized 'STOP' symbol. Immediately identifying the purpose intended by the responder, the border shield 10B provides protection and recognition. Specific graphics such as STOP, HALT OR ALTO" are available in both reflective and non-reflective lettering. Ideal for checkpoint guard posts and border patrol duties.

With reference to FIGS. 11A, 11B, 11C, 11D, 11E, 11F, 12, 13, and 14, in which similar reference numbers are used for similar parts, a patrol shield 10C may have outer dimensions of approximately 18.5×26.5 inches and weigh approximately 20.5 pounds. The Patrol Shield 10C is designed for increased protection during immediate threat situations. School shootings, bomb threats, violent riots, . . . when there is no time to wait for specially trained response teams. Transported in the trunk of the patrol vehicle, this shield is immediately available during any active violent situation. The greater dimensions allow fellow officers to be protected, without lessoning their field of vision. The increased weight is offset by the added support strap and dual handle positions. Easily released shoulder straps, and wrist hook allow the responder to simply let go of the shield, should any rioter attempt to drag the responder into a hostile crowd. The patrol shield 10C may include a bracket 56 for removably retaining a fire extinguisher 58. The patrol shield 10C may also include a strap or harness 54, which may be placed over an arm of a user for additional stability (see FIG. 14).

With reference to FIGS. 15A, 15B, 15C, 15D, and 15E, in which similar reference numbers are used for similar parts, a search shield 10D may have outer dimensions of approximately 12.0×20.0 inches and weigh approximately 10.0 pounds. With the same dimensions as the Officer Shields, these unique shields offer the responder the ability to look into attics, crawl spaces, stairwells and hidden areas when searching for evidence or suspects. You really never know what or who will be encountered.

With specific reference to FIG. 15, a diagrammatic illustration of the light providing mechanism 16 is shown. A protective lens 48A, 48B is placed before each of the first and second lighting devices 18A, 18B. The protective lens 48A, 48B may be transparent or translucent. The lens provides light transmission qualities however, is resistant to penetration from bullets, explosive shrapnel, blunt force, and edged weaponry.

In the illustrated embodiment, each lighting device 18A, 18B includes at least two elements or light emitters 19. The light emitters 19 are at a minimum, a pair of electric components that produces visual illumination when a voltage is applied to it, such as a lamp. Light emitter 19 may include but is not limited to an incandescent light bulb, a light-emitting diode (LED), a fluorescent lamp, a halogen lamp, a lamp based on the light emission of gases (such as a neon light), or any other device known in the art that produces visible illumination with the application of a voltage. The light emitter 19 could, alternatively, be described in terms of its light output in lumens, for example. In another embodiment, light emitter 19 may produce illumination in a non-visible spectrum, such as infrared or ultraviolet (often called a "black light"), for different uses and effects. The light emitters 19 are connected in parallel to the on-off switch 37 as a redundancy in the event that one of the light emitters 19 are rendered in-operable. This parallel wiring approach ensures that one of the light emitters 19 will remain operational in the event that the protective lens 48A, 48B receives a direct or indirect impact over top of one of the light emitters 19 and damages the device 10.

The energy storage device 20A, 20B is preferably a direct current energy or charge storage device that is configured to provide power to the light emitters 19. The energy storage device 20A, 20B can comprise of one or more devices wired in parallel to provide redundant capacity in the event of failure to one or more of the devices. The energy storage device 20A, 20B can include any battery or cell known in the field, including general purpose batteries, alkaline batteries, lithium ion batteries, nickel-cadmium batteries, nickel metal hydride batteries, lead acid batteries, deep cycle batteries, rechargeable batteries, or any other batteries. Further, the energy storage device 20A, 20B may include a broader array of power sources, including but not limited to fuel cells and capacitors. While there is no limit to the voltage or energy content of the energy storage device 20A, 20B, it preferably ranges from a voltage of 1-24 volts, more preferably about 6-12 volts, and more preferably about 11.1 volts.

The energy storage device 20A, 20B may be coupled to a charging receptacle 60 and the on/off switch 37. The charging receptacle 60 may include a connector/switch combination mechanism that allows current to flow through the device. The charging receptacle 60 has two positions of operation available; one, for directing power from the energy storage device 20A, 20B to the on-off switch 37, and two, directing current from an energy charging device 62 to the energy storage device 20A, 20B.

The on-off switch 37 comprises of a device that will close a circuit allowing electricity to flow from the energy storage device 20A, 20B to light emitters 19. The on-off switch 37 may be a typical unbiased switch that remains indefinitely in whichever state it is placed. If a user pushes the on-off switch 37 to the on (or closed) state, for example, the switch 37 will remain in the on state until the user pushes the switch 37 to the off (or open) state. The on-off switch 37 may include any manual or electronic switches or actuators known in the art.

The charging device 62 is a device that delivers electricity from an outside source to the charging receptacle 60. The charging device 62 is a device that is compatible with the energy storage device 20A, 20B in its voltage and current capacities. The charging device 62 may include any type charging configuration known in the art, including wall outlet charging, cigarette lighter outlet charger, or Universal Serial Bus (USB) charger.

In one embodiment, the shield portion 12 has a first side portion 12A and a second side portion 12B. The first lighting device 18A is located on the first side portion 12A and the second lighting device 18B is located on the second side portion 12B.

In a second embodiment, one of the lighting elements 19 associated with the first lighting device 18A and one of the lighting elements 19 associated with the second lighting device 18B are located on the first side portion 12A, and an other one of the lighting elements 19 associated with the first lighting device 18A and an other one of the lighting elements 19 associated with the second lighting device 18B are located on the second side portion 12B.

Industrial Applicability

The CiDe Shield™ products are a unique, innovative protective product specifically designed for uniform patrol and security duties. They offer protection for all first incident responders against ballistic, edged weapons, explosive and incendiary device attacks to their face, head and neck. As responders conduct "every day, routine patrol duties" they are being targeted and attacked at increasing frequencies. Ballistic vests are great; however they don't offer any protection for the head, face or neck. Additional protection is needed for our officers and security personnel, as they face increasingly more violent and potentially deadly attacks. CiDe Shield™ products are an essential life saving device because of they are light weight, transparency and offer advanced design features. Easily handled with one hand, allowing the other hand to remain free, they provide immediate cover for all first incident responders as they face today's challenges.

The CiDe Shield™ products provide additional protection specifically designed for our uniformed patrol officers. A device that would be immediately available to every officer during those "routine" calls for services, which pose the greatest threat. A product that is lightweight and transparent, so it offers protection for the neck up. Finally, a defensive tool that provides cover against hand gun rounds and edged weapon device attacks.

That split second when encountering a dangerous situation, recognizing the threat and then responding to it is critical. Having a device that offers the above described protection would be invaluable and could make all the difference. Officers approaching traffic stops, domestic violence calls, checks subjects . . . may do so from behind such a protective device. The CiDe Shield™ products provide first incident responders with an unobstructed field of vision, while protecting their head, face and neck, from the threats they face every day, during every shift and on every call for service.

The ability to respond from behind a position of cover, for our law enforcement and security personnel have been unrealized as they conduct their rounds and patrol duties. Reliable and consistent illumination is also imperative during these enforcement and protective activities, which is why each CiDe Shield™ product is equipped with a dual high-intensity flood lighting system. Generating a maximum of 600 lumens per light, each shield is equipped with two lights. They not only brighten up every area, allowing the responders greatly improved illumination; they are located behind the protective shield, providing added assurance there will be light when it is needed.

With CiDe Shield™ protective products, each responder would have that increased confidence they are protected, as they identify potential threats, innocent bystanders, fellow officers . . . with increased illumination, while determining the proper response to any given situation.

As our law enforcement officers, security guards, border and federal agents answer calls for service, conduct traffic stops and check out suspicious individuals, they can respond from behind these specifically designed protective shields. There will be a significant decrease in the number of injuries and deaths to our first incident responders, as they utilize CiDe Shield™ protective products.

Designed by first incident responders, for first incident responders, CiDe Shields™ include several features not found in any protective product of its type. Features such as the shields ability to capture rounds, lessoning the chance a reflected bullet could injure a fellow officer or innocent bystander. The high intensity flood lighting system is designed to continue working even if the shield is hit. Located behind the protective material is unique, and each 600 lumen light is independent of the other, increasing the probability that the responder will continue to have illumination. Further, the complete visibility allow the responders back up officer to have the same ability of seeing through the shield, increasing the chances both responders will identify and react appropriately, resulting in a favorable outcome, no matter what the 911 call.

Flood Light System: Standard equipment on all CiDe Shield™ products are the dual high intensity, pure white LED flood light system. Electronically regulated for maximum battery life, temperature protection, and steady output. Each light is independent from the other, with all-weather construction. Each flood light produces a maximum output of 600 lumens, with a two hour continuous run time. Unique to CiDe Shield™ products, our lights are mounted directly behind the shield, so they are also protected. Not only increased visibility but also increased illumination provide the added assurance these lights wouldn't get put out during an attack. Significantly brighter than other light sources, illumination is vital to the responder's safety and the safety of bystanders. This specialized feature provides first incident responders the greater advantage when assessing dangerous situations, and appropriately responding to them.

CiDe Cam Video System: The optional CiDe Cam video capturing system allow for immediate video and audio recording, as viewed by the responder, during any given situation. A 30 frames-per-second, 5 megapixel closed circuit video capturing system with 2.8 mm, 640×480 video graphic array system. Batteries, 2 GB SD Card and USB cable are all included. Affixed directly behind the shield, this system could provide the most valuable evidence needed after the situation has been handled. No software is required and this system is very user friendly.

Fire Extinguisher: The optional fire extinguisher feature provides first incident responders an additional tool, should they need to address fire bomb and/or Molotov cocktail attacks. Attached behind the Patrol or AVI Shields, this feature allows responders increased confidence should they find themselves under an incendiary device attack. The special extinguisher fluid is water soluble, eliminating the need to scrub abrasive chemicals from burn victim wounds.

Quick Release Belt Clip: This feature allows officers to carry the Officer or Search Shields with them at all times, without give up a hand to carry it. This clip easily slips onto any duty belt and provide easy access to the shield at all times by lifting upwards on the shield's handle. Additional "Alice Clip" design is available for military style tactical vests and jackets.

Detachable Shoulder Strap: The shoulder strap feature is standard with all AVI and Patrol Shields, allowing for increased comfort during extended situations like school shootings, riots or barricaded gunman situations. This feature is easily detached from the responder, should anyone attempt to drag a responder into a crowd.

Customized Insignia: Interlocking Safety Trim: Carry Case: All CiDe Shield™ products come complete with everything needed to keep them fully functional at all times. Protective carrying case, battery charger for the dual flood light system, customized insignia and interlocking safety trim are all standard features. The vertical groove along the shields protective trim allows other shields the ability to form a connective wall. Insignias can be either reflective or non-reflective and labeled as required; Police, Sheriff, Security, Halt, Stop, . . . .

Product Testing: All testing to date support that CiDe Shield™ products provide significant protection against the most deadly threats faced by all first incident responders; Ballistic, Edged Weapons, Explosive and Incendiary. CDT have tested our shields both internally and by utilizing outside evaluators to make sure our shields provide the ballistic and edged weapon protection needed by our first incident responders. Though our shield material has been tested and certified under Standard 752 of the Underwriters Laboratories (UL) for ballistic rating, our final completed products still need to be tested in accordance with the National Institute of Justice (NIJ) ballistic resistant materials Standard 0108.01 and the NIJ stab resistance materials Standard 0115.0.

Ballistic Protection: Internal Testing: CDT conducted several internal tests to ensure CiDe Shield™ products could withstand various small arms rounds, fired from a distance of 15 feet at a 90 degree angle. These rounds included .380, .38, .40, .357, 9 mm and even the 45 mm caliber Black Talon, or "cop killer," bullet. In all tests, none of the rounds penetrated the shield, and were also captured by the shield material, reducing if not eliminating the danger of injuries from ricochet or shrapnel to innocent bystanders or fellow officers. Internal testing demonstrated the CiDe Shield™ products provide a significant level of ballistic protection, while remaining transparent and lightweight. Further, multiple .40 caliber rounds were fired into this Officer Shield, with the lights on, to see how they would respond.

External Testing: External ballistic testing has been completed by ballistics expert David R. Nickols, of Mid-Michigan Guns & Gear, LLC. A well respected and recognized expert in firearms and ballistic testing, Mr. Nickols has prior ballistic testing experience for various government contracts. Mr. Nickols is a licensed gunsmith and ballistician with more than 35 years of experience in the field. He has been a tactical rifle builder for 15 years and has been conducting ballistic and armor testing for various corporations. He is recognized by district and circuit courts as a ballistics and firearms expert, and Nickols was assisted by Dan Ankney, an NRA instructor. Multiple rounds were fired from a distance of 15 feet, from both 90 degree and 45 degree angles. None of the rounds penetrated the shields, and there were no ricochet, back splash, shrapnel or spalling from these tests. David R. Nickols stated the CiDe Shields successfully stopped all tested rounds without any penetration, which he added was an exceptional.

CiDe Shields were tested against the following small arms rounds, resulting in Zero Penetration:

| Round | Bullet | Grain |
|---|---|---|
| 22 Long Rifle | Lead | 38 |
| 22 Magnum | Full Metal Jacket | 50 |
| 380 ACP | Full Metal Jacket | 95 |
| 38 Special + P | Carbon Hollow Point | 110 |
| 38 S & W Standard | Jacketed Hollow Point | 158 |
| 9 MM | Full Metal Jacket | 124 |
| 9 MM | Hydra Shock | 147 |
| 40 S & W | Full Metal Jacket | 155 |
| 40 MM S&W | Full Metal Jacket | 180 |
| 357 Magnum | Jacketed Hollow Point | 125 |
| 10 MM | Full Metal Jacket Match | 180 |
| 45 Black Talon | Jacketed Hollow Point | 230 |
| 45 Auto | Full Metal Jacket | 230 |
| 44 Magnum | Jacketed Hollow Point | 200 |
| .357 | Jacketed Soft Point | 158 |
| .44 Magnum | Lea Semi-Wadcutter | 240 |

Stab Resistant Protection: Edged Weapons Testing: Internal Stab Resistant testing conducted by CDT included multiple attempts to penetrate our shields utilizing various known edged weapons; including knives, ice picks, daggers and swords. We were unable to cause any penetration through our shields, and decided to put these shields through the extreme test of firing arrows into them. Utilizing the assistance of avid bow hunters, we asked them to choose the most destructive arrow they could. The result was that several "bone crushing" arrows were fired from 70 pound compound bows, directly into our shields from a distance of 15 feet. The result was that none of the arrows penetrated our shields and all of the 128 grain arrows were destroyed.

These responders attempted to penetrate our shields with their arrows, which we believe would have penetrated the vests worn by most officers. However not one arrow was able to pierce through to the other side of our shields, and only two arrows actually stuck in the protective material. As a result of the zero penetration observed from these internal tests, additional edged weapons testing, documentation and certification will be conducted in accordance with the NIJ Stab Resistance of Personal Body Armor, Standard 0115.00, which will be pursued as soon as funding is available.

Explosive Resistance: CDT is confident that the CiDe Shield™ products help to protect against lower velocity shrapnel and the over pressure from various explosive devices, and is currently in the process of raising funds to undergo testing for certification in this area. Roadside bombs, grenades and various devices encountered by first incident responders should not be approached without protection. CiDe Shield™ products are designed to offer protection against various threats, including bombs and explosive devices. Governmental testing, documentation and certification will be pursued as soon as funding is available.

Incendiary Protection: CDT is concerned that our first incident responders do not have a way to protect themselves should they come under attack from Molotov cocktails, fire bombs or any other incendiary devices. It is because of this concern that we offer a special fire extinguisher for our Patrol and AVI Shields. A counter-attack device that would be immediately available to the responder, if needed.

CiDe Shield™ products are designed for everyday patrol duty, constructed of solid, all weather resistant materials that provide immediately ballistic, edged weapon and explosive protection during any call for service, traffic stop, or active violent incident (AVI). Fully protecting the officer's head, face, and neck.

The larger AVI and Patrol Shields are designed to be carried with the responder, and in the trunk of the patrol vehicle, making it readily available at a moment's notice. It comes complete with a sturdy carrying case, quick deploy and/or release forearm support hook, duel handle placement for alternative carrying possibilities, duel ultra bright, high intensity flood light system, and water soluble fire extinguisher. The rubber trim has been designed to protect the shield, the officer, and the public. It has also been designed so that it can be coupled with other shields when creating a unified wall is necessary, as in riot situations.

They are lightweight and easily carried/held with the officer's non-gun hand. The duel handle placement allows the officer to either hook the forearm under the support hook while grabbing the adjacent handle, or grab the upper handle and allow the forearm to rest against the supporting foam. The officer is then able to hold the shield in front, keeping the officer's gun hand free. The officer holds the ballistic shield in front of the face, and high enough to protect the entire head. The ON/OFF switch activates both lights simultaneously, and is located between both handles for easy access. Should the need arise, the fire extinguisher is immediately released and removed by un-hooking the supportive latch. The dual, 600 Lumen High Intensity Flood lighting feature allows officers greater illumination, combined with the protective qualities.

The smaller Officer Shields are designed to be issued to and carried in the patrol vehicle, right next to the officer, making it immediately available on every call and/or traffic stop. It comes complete with a sturdy carrying bag, ultra bright, high intensity flood light, rubber trim, and identification decal. Constructed of the same ballistic, edged weapon and explosive resistant material, the Officer Shields have been designed to replace the flashlights officers presently utilize, as the 600 Lumen High Intensity Flood light provides greater lamination for the officer, along with the protective qualities.

The Officer and Search Shields weigh approximately 10 lbs. and are held with the officer's non-gun hand. The officer is able to access this shield at a moments notice, grabbing the handle and holding the shield in front, keeping the officer's gun hand free. The officer holds the ballistic shield in front of the face, and high enough to protect the entire head. The ON/OFF switch is located above the handle for easy access.

Our high intensity, 600 Lumen High Intensity Flood light source eliminates the need for a flashlight. Further, these lights are independent of each other, should one light become damaged the other light continues to operate and both lights are protected behind the shields material.

The results achieved by CiDe Shield™ products, is that police officers, county deputies, state troopers, boarder patrol agents, security guards and all other first incident responders will be protected from the neck up. Not only protected, but to have this protection available to them when they need it the most, that being right away during every shift, traffic stop and calls for service. CiDe Shield™ products have been designed to replace the flashlight officers presently carry, because our shields provide a protected, duplicate, brighter light; along with ballistic, edged weapon and explosive protection.

Additionally, law enforcement has not had immediate access to ballistic shields during routine patrol duties, however with CiDe Shield™ products they can now be protected, from the neck up, and against bullets, edged weapons, and explosive devices.

Ballistic material used in police vests, worn by officers are not Edged Weapon Resistant. Assaults on officers by knives, swords, and even arrows will penetrate and injure, if not kill the officer. "Cop Killer" bullets, designed to slice through these vests have razors in them. CiDe Shield™ products have been tested by shooting them with multiple "bone crushing" arrow heads, and .45 caliber "Cop Killer" bullet, with Zero Penetration.

The flashlights being carried by law enforcement have approximately 110 Lumens of Illumination; however we are able to offer a protective product that produces 600 Lumens of Illumination.

CiDe Shield™ products are designed to have a flat surface. Where other shield designs feature a curved design, we have learned that some bullets will actually ricochet off our shields. This would create a danger innocent bystanders and fellow officers. With our flat design, bullets that ricochet will be sent back towards the sender.

CiDe Shield™ products have no distortion of vision. When looking through our shields your vision is not refracted or changed in any way.

CiDe shields are also equipped with a water soluble fire extinguisher capable of putting out intention attacks by Molotov Cocktails or other incinerator/flammable devices, thus protecting the officer or a bystander.

Advanced Design: Flat Surface to prevent ricochets from striking innocent bystanders or fellow officers. Lightweight; Portable and easy to carry. Ballistic, Edged weapon, Explosive Resistant Protection. Additional protection against Incinerate/Fire Attacks. Illumination; 600 Lumen High Intensity Flood Lights. Dual lights, independent of each other for increased confidence. Transparent; No distortion of vision or blocked visibility. Interlocking Trim protection. Bullets captured within the shield material, providing evidence. 30 fps video/audio camera option also protected behind the shield. Immediately available to responders during every call or situation.

New Application: Designed for every day usage to be carried by all officers, during every shift of duty, so that they have the protection at a moments notice. Immediate protection against life threatening attacks for the neck, face and head. Increased illumination, which is protected behind the shield, lessoning the chance of losing essential lighting. Captured rounds and video/audio evidence of attacks.

More Protection: Not just Ballistic Protection, but Edged Weapon, Explosive Resistant Protection, and protection against incinerator/flammable device attacks.

Our shields are intended to further offer additional innovative features: Infrared Lighting for covert operations. Phycho-physical Alternate Light Source. Thermal Imaging Camera & Light Source.

What is claimed is:

1. A protective apparatus, comprising:

a shield portion having an outer edge, a front surface, and a rear surface, the shield portion being composed of a transparent material;

a trim portion made of a flexible material affixed to the outer edge of the shield portion, the trim portion having an outer rim, a channel being formed in the outer rim;

a light providing mechanism coupled to the rear surface of the shield portion, the light providing mechanism including a first lighting device and a second lighting device;

a first energy storage device electrically coupled to the first lighting device for providing electrical power thereto; and, a second energy storage device electrically coupled to the second lighting device for providing electrical power thereto, the first and second energy storage devices being independent.

2. A protective apparatus, as set forth in claim 1, further including:

a support structure fixed to the rear surface of the transparent shield portion, the support structure having a rear surface; and, a handle fixed to the rear surface of the support structure.

3. A protective apparatus, as set forth in claim 2, the protective apparatus having a vertical axis, the handle being parallel to the axis.

4. A protective apparatus, as set forth in claim 2, the protective apparatus including a vertical axis, the handle being perpendicular to the axis.

5. A protective apparatus, as set forth in claim 2, further comprising a second handle.

6. A protective apparatus, as set forth in claim 1, further comprising:

a light housing coupled to the rear surface of the shield portion, the light housing having an opening facing the shield portion, the light providing mechanism being contained within the light housing; and, a protective lens coupled to the opening, the light providing device being located behind the protective lens such that the protective lens is between the light providing device and the shield portion.

7. A protective apparatus, as set forth in claim 1, wherein each of the first and second lighting devices includes at least two lighting elements.

8. A protective apparatus, as set forth in claim 7, the shield portion having a first side portion and a second side portion, one of the lighting elements associated with the first lighting device and one of the lighting elements associated with the second lighting device being located on the first side portion, and an other one of the lighting elements associated with the first lighting devices and an other one of the lighting elements associated with the second lighting devices being located on the second side portion of the shield portion.

9. A protective apparatus, as set forth in claim 1, the shield portion having a first side portion and a second side portion, the first lighting device being located on the first side portion of the shield portion, the second lighting device being located on the second side portion of the shield portion.

10. A protective apparatus, as set forth in claim 1, wherein the shield portion is generally flat.

11. A protective apparatus, as set forth in claim 1, further comprising a video camera mounted behind the shield portion.

12. A protective apparatus, as set forth in claim 11, further comprising a support structure fixed to the rear surface of the transparent shield portion, the support structure having a rear surface, the video camera being mounted to the support structure.

13. A protective apparatus, as set forth in claim 1, the shield portion having a generally rectangular shape.

14. A protective apparatus, as set forth in claim 1, the shield portion having a general octagon shape.

15. A protective apparatus, as set forth in claim 1, further comprising a bracket located behind the shield portion for receiving a fire extinguisher.

16. A protective apparatus, comprising:

a shield portion having an outer edge, a front surface, and a rear surface, the shield portion being composed of a transparent material;

a support structure fixed to the rear surface of the transparent shield portion, the support structure having a rear surface;

a handle fixed to the rear surface of the support structure;

a trim portion made of a flexible material affixed to the outer edge of the shield portion, the trim portion having an outer rim, a channel being formed in the outer rim;

a light housing coupled to the rear surface of the support structure, the light housing having an opening facing the support structure;

a light providing mechanism coupled to the rear surface of the shield portion and being contained within the light housing, the light providing mechanism including a first lighting device and a second lighting device;

a protective lens coupled to the opening, the support structure having one or more apertures, the protective lens being located behind the apertures;

a first energy storage device electrically coupled to the first lighting device for providing electrical power thereto; and, a second energy storage device electrically coupled to the second lighting device for providing electrical power thereto, the first and second energy storage devices being independent.

17. A protective apparatus, as set forth in claim 16, the protective apparatus having a vertical axis, the handle being one of parallel and perpendicular to the axis.

18. A protective apparatus, as set forth in claim 17, further comprising a second handle.

19. A protective apparatus, as set forth in claim 17, further comprising a video camera mounted behind the shield portion mounted to the support structure.

20. A protective apparatus, as set forth in claim 16, wherein each of the first and second lighting devices includes at least two lighting elements, the shield portion having a first side portion and a second side portion, the first lighting device being located on the first side portion of the shield portion, the second lighting device being located on the second side portion of the shield portion.

21. A protective apparatus, as set forth in claim 16, the shield portion having a first side portion and a second side portion, one of the lighting elements associated with the first lighting device and one of the lighting elements associated with the second lighting device being located on the first side portion, and an other one of the lighting elements associated with the first lighting devices and an other one of the lighting elements associated with the second lighting devices being located on the second side portion of the shield portion.

22. A protective apparatus, as set forth in claim 16, wherein the shield portion is relatively flat.

23. A protective apparatus, as set forth in claim 16, further comprising a bracket located behind the shield portion for receiving a fire extinguisher.

24. A protective apparatus, comprising:

a shield portion having an radially outer edge, a front surface, and a rear surface, the shield portion being composed of a transparent ballistic material;

a trim portion coupled to the shield portion radially outer edge, the trim portion including an radially outer rim and a center channel formed within the radially outer rim, the center channel extending a full circumferential distance about the shied portion radially outer edge;

a light providing mechanism coupled to the rear surface of the shield portion, the light providing mechanism including a first lighting device and a second lighting device;

a first energy storage device electrically coupled to the first lighting device for providing electrical power thereto; and, a second energy storage device electrically coupled to the second lighting device for providing electrical power thereto, the first and second energy storage devices being independent.

* * * * *